US006644665B1

(12) United States Patent
Brooks

(10) Patent No.: US 6,644,665 B1
(45) Date of Patent: Nov. 11, 2003

(54) OCTAGON CUBE SPACIAL LOGICAL TOY

(76) Inventor: David W. Brooks, 3802 Damon St., Apt. No. 108, Eau Claire, WI (US) 54701

( * ) Notice: Subject to any disclaimer, the term of this patent is extended or adjusted under 35 U.S.C. 154(b) by 48 days.

(21) Appl. No.: 09/944,453

(22) Filed: Sep. 4, 2001

Related U.S. Application Data

(60) Provisional application No. 60/302,767, filed on Jul. 5, 2001.

(51) Int. Cl.[7] ..... A63F 9/08

(52) U.S. Cl. ..... 273/153 S; 273/155

(58) Field of Search ..... 273/153 S, 155, 273/153 R, 157

(56) References Cited

U.S. PATENT DOCUMENTS

| | | | | |
|---|---|---|---|---|
| 4,378,116 A | | 3/1983 | Rubik | |
| 4,378,117 A | | 3/1983 | Rubik | |
| 4,410,179 A | | 10/1983 | Rubik | |
| 4,416,453 A | | 11/1983 | Sasso | |
| 4,478,418 A | | 10/1984 | Sherman, Jr. | |
| 4,500,090 A | | 2/1985 | Nieto | |
| 4,529,201 A | | 7/1985 | Nadel | |
| 4,593,908 A | | 6/1986 | Ibrahim | |
| 5,992,850 A | * | 11/1999 | Li | 273/153 S |
| 6,129,356 A | * | 10/2000 | Li | 273/153 S |

FOREIGN PATENT DOCUMENTS

| | | | | |
|---|---|---|---|---|
| DE | 3149316 | * | 6/1983 | 273/153 S |
| DE | 3333914 | * | 4/1985 | 273/153 S |
| RU | 1258456 | * | 9/1986 | 273/153 S |
| RU | 1729545 | * | 4/1992 | 273/153 S |

OTHER PUBLICATIONS

Brochure from Evercheering Enterprise Co., Ltd, Jun. 1981.*

* cited by examiner

*Primary Examiner*—Kien T. Nguyen
(74) *Attorney, Agent, or Firm*—Tipton L. Randall

(57) ABSTRACT

The present invention is directed to a spacial logical toy having a total of twenty-six toy elements mounted on a spherical internal connecting element. The toy elements are assembled to a spacial body having an octagon cross section on any of the three mutually perpendicular axes. The surfaces of the twenty-six toy elements that make up the geometric solid are provided with one of three colors and are sequentially numbered (1–26) or lettered (A–Z) to provide each surface with a unique designation. The twenty-six toy elements are mixed by rotation of any adjacent nine elements relative to the remainder of the geometric solid. The objective or solution is to return the toy elements to an original sequential orientation.

20 Claims, 12 Drawing Sheets

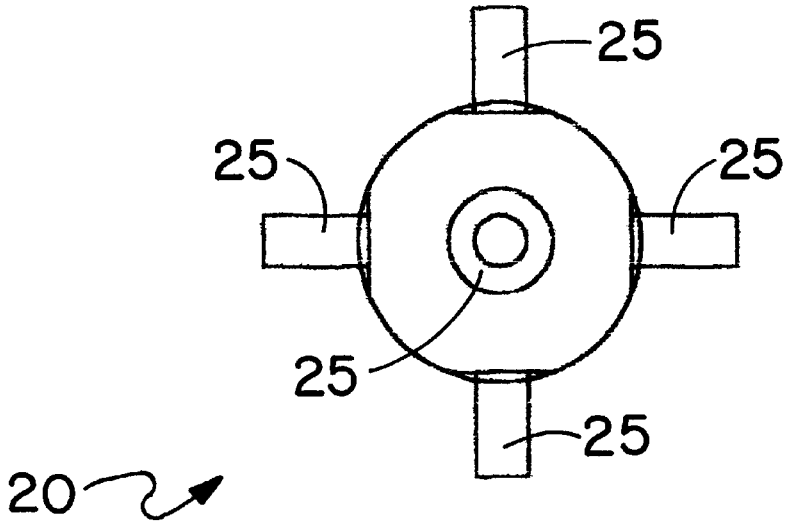
Figure 3
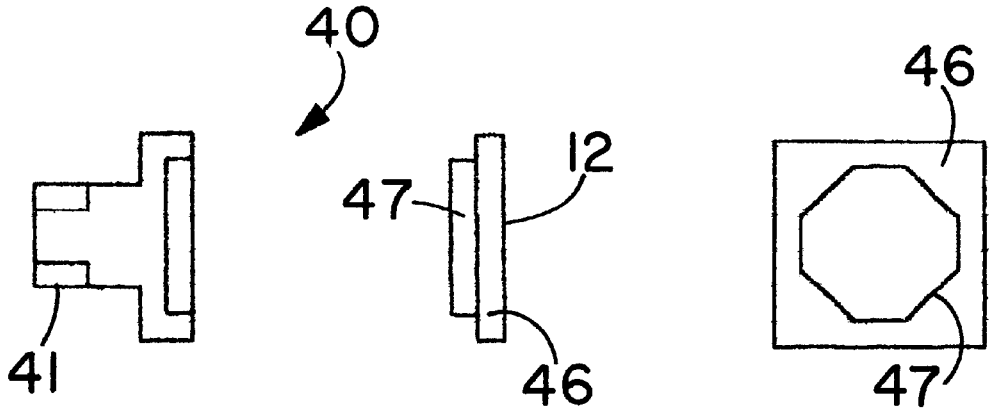
Figure 4a
Figure 4b
Figure 4c

OCTAGON CUBE SPACIAL LOGICAL TOY

CROSS-REFERENCE TO RELATED APPLICATIONS, IF ANY

This application claims the benefit under 35 U.S.C. §119 (e) of co-pending provisional application Serial No. 60/302,767, filed Jul. 5, 2001. Application Ser. No. 60/302,767 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a spacial logical toy having a total of twenty-six toy elements mounted on a spherical internal connecting element. The elements are assembled to a spacial body having an octagon cross section on any of the three mutually perpendicular axes.

2. Background Information

The well-known "Rubik's Cube" is a regular geometrical solid confined by planes, preferably a cube, built up of twenty-six small cubic toy elements, with any nine small cubes forming one surface of the overall larger cube, and which may be rotated in any direction of the spacial axes of the toy along spatial axes withing the cube. The small cubic elements forming the plane surface of the large cube are either colored or indicated with numbers, figures or any other symbols. According, by rotating the cubes, several combinations become possible in compliance with the contents yielded by the cube surface identifiers.

A number of patents have been granted that are concerned with various spacial logical toys and devices. Rubik, in U.S. Pat. No. 4,378,116, describes a spacial logical toy with eighteen toy elements arranged in a 3×3×2 matrix. Rotation of a portion of the matrix along either the X, Y or Z axis is possible. Solving the puzzle is similar to the 3×3×3 matrix. Rubik, in U.S. Pat. No. 4,378,117, describes another spacial logical toy with eight toy elements arranged in a 2×2×2 matrix. The geometrical shape can be a cube or a sphere, with rotation of a portion of the matrix along either the X, Y or Z axis. The structure employs a spring loaded connector to hold the matrix pieces together.

In U.S. Pat. No. 4,410,179, Rubik discloses a cylindrical shiftable element puzzle. The puzzle has two tiers of six elements each, with the pieces rotatable about three axes as well as between the two tiers. Sasso, in U.S. Pat. No. 4,416,453, describes a puzzle in the form of a multicolored regular solid. Plates on the faces of the solid have multiple colors and the objective is to arrange the plates so that no two colors of adjacent plates are the same.

In U.S. Pat. No. 4,478,418, Sherman, Jr. discloses a three-dimensional sliding element puzzle having a spherical inner support with circular tracks for movement of the puzzle pieces. One puzzle with square and triangular surface pieces is shown. U.S. Pat. No. 4,500,090 by Nieto describes a polyhedral puzzle with a central body of polyhedron shape on the faces of which are pivoted with the intermediate body pieces slidably carrying the external body elements. Nadel, in U.S. Pat. No. 4,529,201, discloses a geometrical puzzle toy with a spherical base and with a plurality of tile members that are attachable to the base member. A variety of polyhedron shapes can be produced with various tile shapes.

In U.S. Pat. No. 4,593,908, Ibrahim describes a movable block geometrical puzzle having eight core pieces and having rotatable pyramid pieces connected to plane surfaces formed by the surfaces of at least two of the core pieces. The puzzle uses the 2×2×2 matrix configuration for the core blocks and exhibits the same movements as the cubic 2×2×2 matrix puzzle. The puzzle provides rotatable movement of pyramid blocks about an axis perpendicular to the plane surface to which the blocks are secured, as well as movement along with the supporting core blocks.

None of the above patents disclose a spacial logical toy having a total of twenty-six toy elements mounted on a spherical internal connecting element, with the elements assembled to a spacial body having an octagon cross section on any of the three mutually perpendicular axes.

SUMMARY OF THE INVENTION

The invention is a spacial logical toy composed of a spherical core member plus twenty-six surrounding pieces arranged in a 3×3×3 matrix structure that has an octagon cross section along the X, Y, and Z symmetry axes of the matrix structure. The spacial logical toy is a regular geometric solid having a total of twenty-six planar exterior surfaces. The surfaces include eighteen square surfaces and eight triangular surfaces and is highly symmetrical with three orthogonal symmetry axes.

The spherical core member includes six cylindrical connector assemblies oriented along the three orthogonal symmetry axes of the toy. The twenty-six surrounding pieces include three sets of toy elements, a first set of six identical elements, a second set of eight identical elements and a third set of twelve identical elements. The first set of six toy elements are each T-shaped with a hollow bore sized to accept a cylindrical connector assembly from the base of the T-shaped element. The T-shaped toy elements each include a square surface which forms part of the geometric solid surface. The second set of toy elements each includes a triangular surface which forms part of the geometric solid surface, and third set of toy elements each includes a square surface which forms part of the geometric solid surface. The second set and third set of toy elements each include integrally formed cam elements, with each cam element having a spherical section surface for positioning adjacent the spherical core member.

With the T-shaped toy elements each secured to one cylindrical connector assembly of the spherical core member, the second and third sets of toy elements are interlockingly secured in the geometric matrix by the cam element present on each toy element. The configuration of the three sets of toy elements allows for any group of nine adjacent toy elements with one T-shaped toy element at the center to be rotated about one of the coordinate axes relative to the remainder of the octagon cube toy.

In a preferred embodiment of the invention, the twenty-six outer surfaces of the octagon cube toy are each provided with one of three colors. In one embodiment the colors red, white and blue are employed. One center T-shaped toy element is colored red and the center T-shaped toy element directly across the octagon cube is colored blue. The other four center T-shaped toy elements are colored white. Each toy element exterior surface touching the red center T-shaped toy element is also colored red, while each toy element exterior surface touching the blue center T-shaped toy element is also colored blue. The remaining toy element exterior surfaces are colored white. The twenty-six exterior surfaces of the octagon cube toy are also numbered or lettered consecutively. This configuration is designated as the "solution" to the octagon puzzle matrix. The smaller sections of the octagon cube are mixed up by rotation of various puzzle faces, and then reconfigured to the original structure. The three colors of the octagon cube matrix surface can be selected to represent the colors of the flag of a particular country.

In an alternative embodiment of the invention, the spacial logical toy includes a spherical core member plus twenty-six surrounding pieces arranged in a 3×3×3 matrix structure that has an octagon cross section along the X, Y, and Z symmetry axes of the matrix structure. The spacial logical toy is a regular geometric solid having a total of forty-two planar exterior surfaces. The surfaces include eighteen square surfaces and twenty-four triangular surfaces and is highly symmetrical with three orthogonal symmetry axes.

The spherical core member includes six cylindrical connector assemblies oriented along the three orthogonal symmetry axes of the toy. The twenty-six surrounding pieces include three sets of toy elements, a first set of six identical elements, a second set of eight identical elements and a third set of twelve identical elements. The first and third sets of toy elements are as described above, while the second set of toy elements each has three triangular surfaces positioned on the toy outer surface. The inner construction of the three sets of toy pieces is as described above. In a preferred embodiment, the exterior surfaces of the toy has twelve different colors, with the surfaces configured to form twelve hexagon surfaces, one of each of the twelve different colors employed. This configuration is designated the "solution " to the alternative embodiment of octagon puzzle matrix.

BRIEF DESCRIPTION OF THE DRAWINGS

FIG. 3 shows a plan side view of the spherical core member of the octagon-cube toy of the present invention.

FIG. 4*a* shows a cross-sectional view of one part of the six identically shaped toy elements of the first set of the present invention.

FIG. 4*b* shows a cross-sectional view of the other part of the six identically shaped toy elements of the first set of the present invention.

FIG. 4*c* shows a bottom view of the other part of the six identically shaped toy elements of the first set of the present invention.

DESCRIPTION OF THE EMBODIMENTS

Nomenclature

10 Octagon Cube Toy
12 Square Exterior Surface
14 Triangular Exterior Surface
20 Spherical Core Member
25 Cylindrical Connector Assemblies of Core Member
40 Toy Element of First Set
41 Base of T-shaped Toy Element
42 Cylindrical Spacer Member
43 Washer Member
44 Snap Ring Member

45 Groove in Connector Member
46 Square Cover Member
47 Lip Portion of Cover Member
60 Toy Element of Second Set
61 Tetrahedron Body Portion
62 Cam Element
63 Spherical Section Surface
80 Toy Element of Third Set
81 Solid triangular Body Portion
82 Cam Element
83 Spherical Section Surface
100 Octagon Cube Toy
114 Triangular Exterior Surface
160 Toy Element of Second Set
161 Tetrahedron Body Portion
162 Cam Element
163 Spherical Section Surface

Construction

Figure 2:
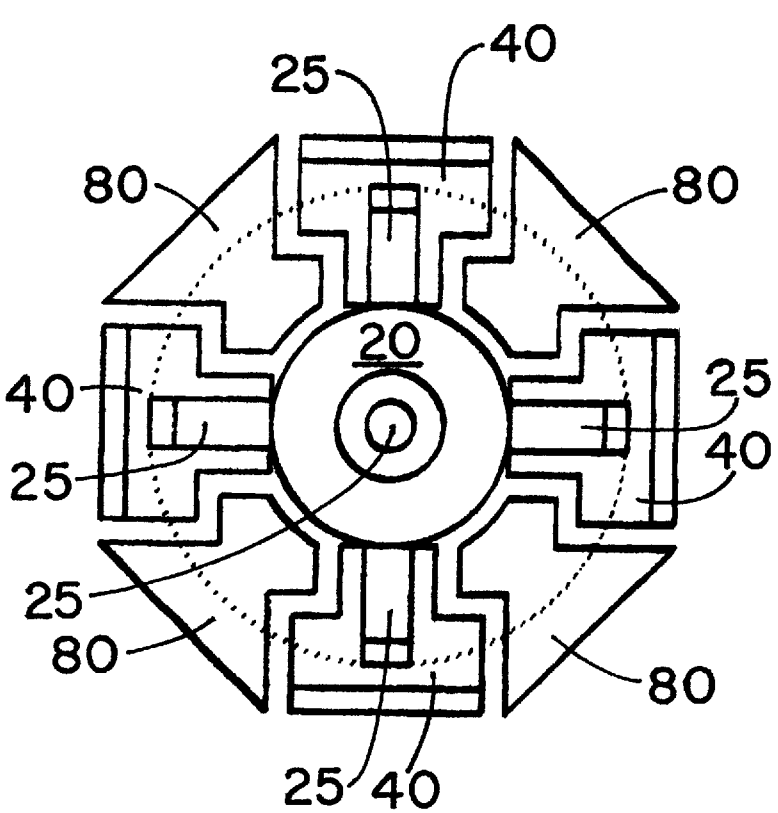
FIG. 2 shows a cross-sectional view taken on one of the three planes formed by any two of the coordinate axes of the octagon-cube toy of the present invention.
Figure 1:
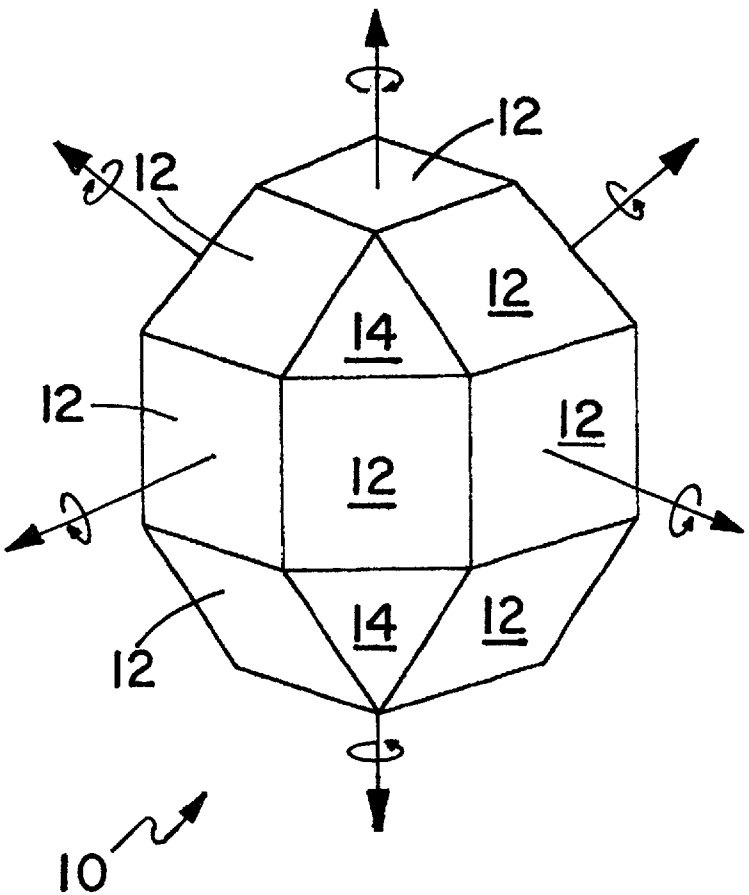
FIG. 1 shows the octagon-cube toy in the assembled state.

Referring to FIGS. 1 and 2, one embodiment of the octagon cube spacial logical toy 10 of the present invention is shown. The octagon cube spacial logical toy 10 is a regular geometric solid having a total of twenty-six planar exterior surfaces. The surfaces include eighteen square surfaces 12 and eight triangular surfaces 14 and is highly symmetrical with three orthogonal symmetry axes as depicted in FIG. 1. FIG. 2 is a cross-sectional view of the toy 10 taken on one of the three planes formed by any two of the three orthogonal symmetry axes of FIG. 1. The cross-sectional view is a regular octagon and portions of the interior structure of the toy 10 are revealed in FIG. 2.

The spherical core member 20 of the toy 10 is shown in FIG. 3. The core member 20 includes six cylindrical connector assemblies 25 oriented along the three orthogonal symmetry axes of the toy 10. The connector assemblies 25 serve to anchor the twenty-six toy elements, each with one planar exterior surface, that make up the regular geometric surface of the toy 10. The toy 10 includes an assembly of twenty-six toy elements secured about the spherical core member 20 to generate a regular geometric solid with each toy element having a single flat surface on the regular geometric solid surface.

The twenty-six toy elements that form the exterior surface of the toy 10 include three sets of toy elements, a first set of six identical elements 40, a second set of eight identical elements 60 and a third set of twelve identical elements 80. The second set of toy elements 60 and third set of toy elements 80 include integrally formed cam elements, each cam element having a spherical section surface for positioning adjacent the spherical core member 20.

Figure 7A:
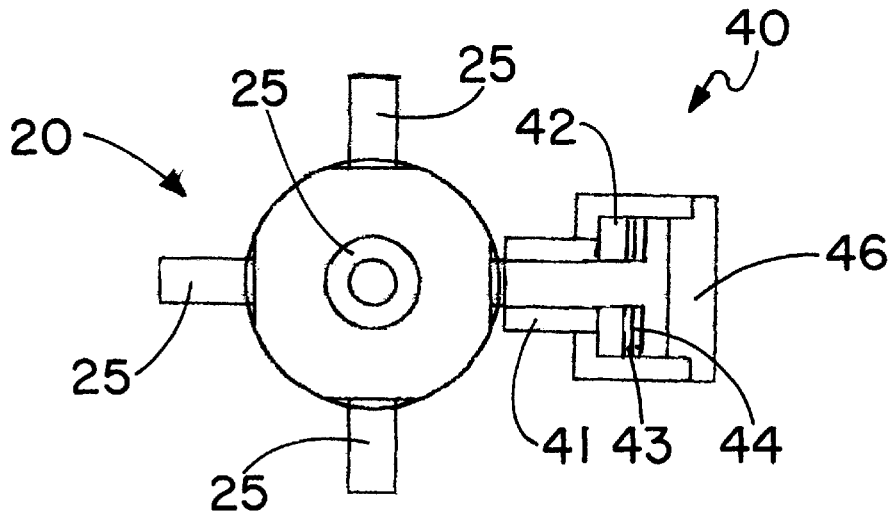
FIG. 7*a* shows an plan view of the connector assembly employed for securing each of the six toy elements of the first set to one of the assemblies of the spherical core member of the present invention.
Figure 7B:
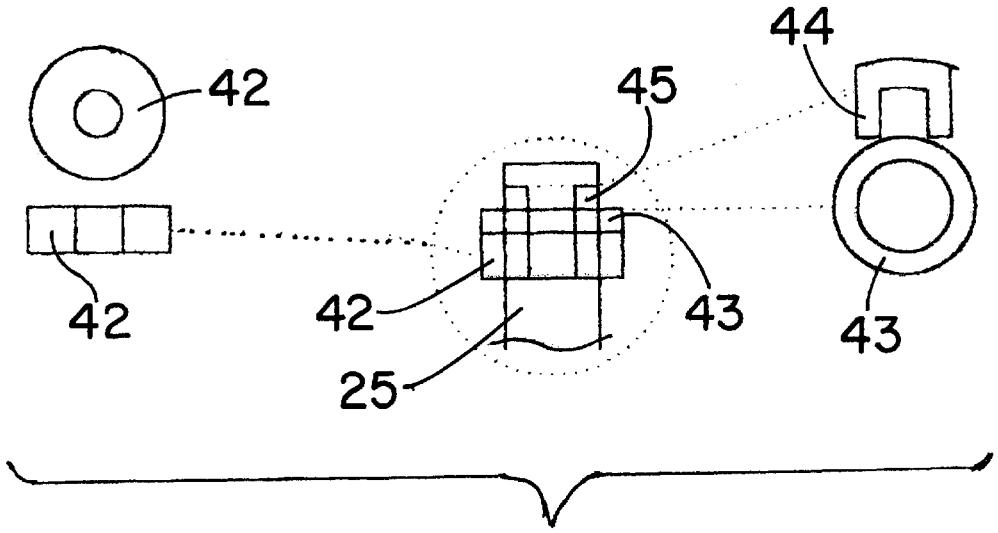
FIG. 7*b* shows an exploded plan view of the connector assembly of the spherical core member of the present invention.
Figure 8:
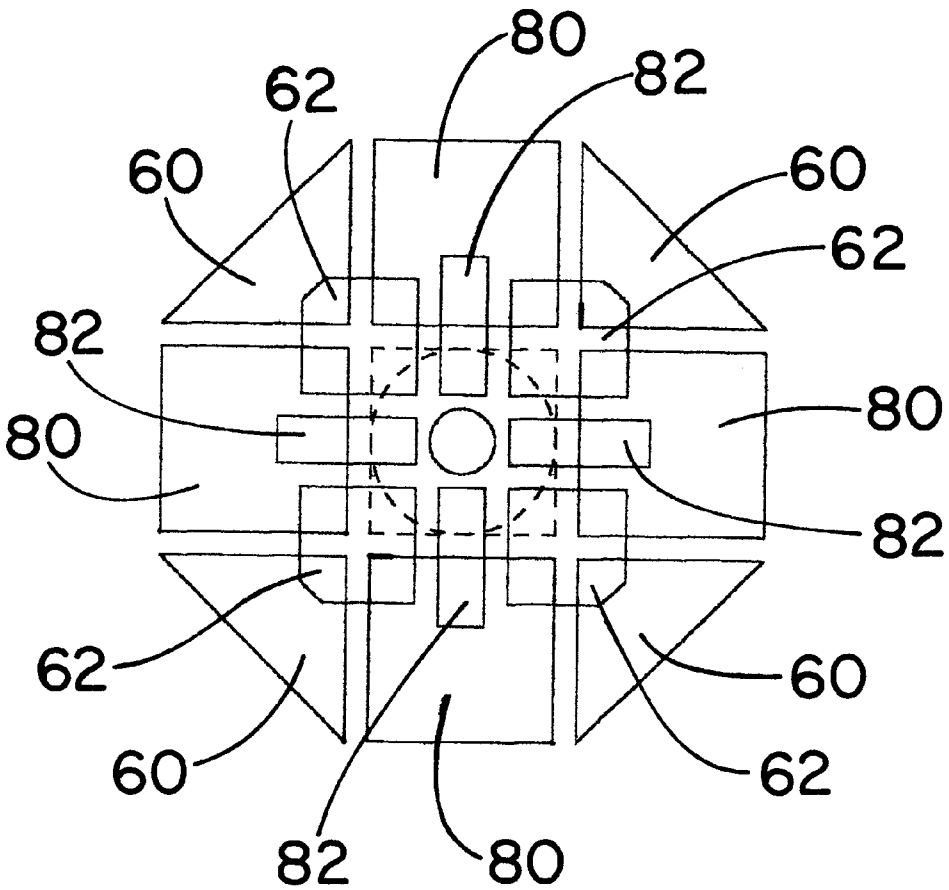
FIG. 8 shows a cross-sectional view taken between two of the three planes formed by any two of the coordinate axes of the octagon-cube toy of the present invention.
Figure 9C:
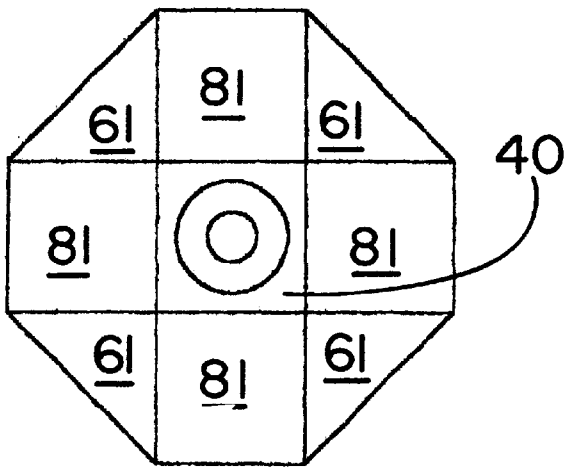
FIG. 9*c* shows the relationship between the first, second and third sets of toy elements of the present invention.
Figure 9B:
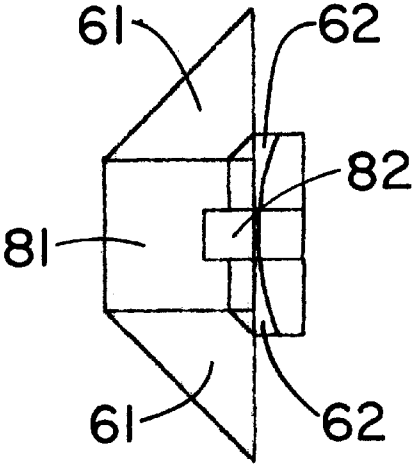
FIG. 9*b* shows the interlocking relationship between the second and third sets of toy elements of the present invention.
Figure 9A:
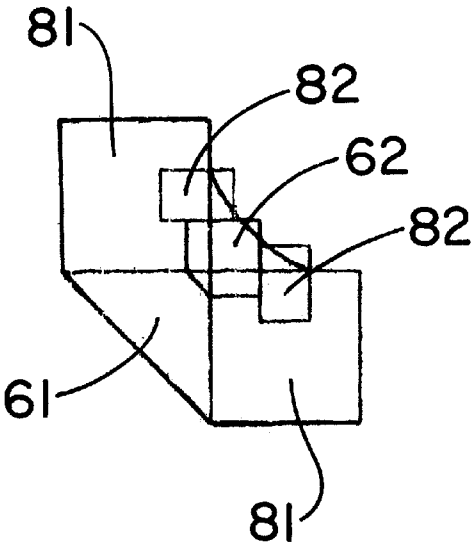
FIG. 9*a* shows the interlocking relationship between the second and third sets of toy elements of the present invention.

The first set of six identical toy elements 40 are T-shaped with a hollow bore there through, as shown in FIGS. 4*a*–4*c*. The bore is sized to accept a cylindrical connector assembly 25 from the base 41 of the T-shaped element 40. The hollow bore is enlarged within the T-shaped element 40 to provide space for an elastomeric biasing cylindrical spacer member 42 to encircle the cylindrical connector assembly 25 and be retained thereon by a washer member 43 with a snap ring member 44 that clips into a groove 45 near the end of the cylindrical connector assembly 25, as depicted in FIGS. 7*a* and 7*b*. The T-shaped element 40 includes an open top for installing the biasing spacer 42 and washer member 43 plus snap ring retainer member 44 on the connector assembly 25 while it is within the T-shaped element 40. The T-shaped element 40 also includes a square cover member 46 with a lower lip portion 47 that fits into the open top bore of the element 40 to seal the connector assembly 25 therein. The lip portion 47 is preferably non-circular to prevent rotation of the square cover member 46 when engaged in the bore of the T-shaped element 40. The retained biasing spacer 42 maintains the T-shaped element 40 at a selected location on the connector assembly 25, but allows for slight movement of the T-shaped element 40 away from the spherical core member 20 along the connector assembly 25 by compression of the spacer 42 against the retaining washer 43.

Figure 5A:
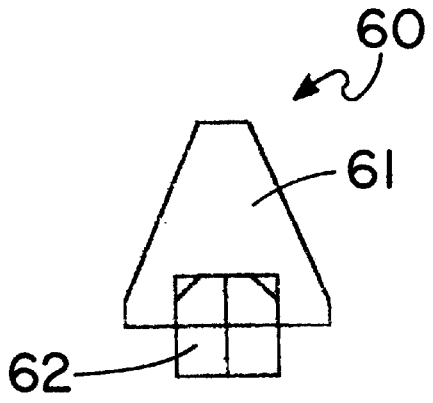
FIG. 5*a* shows a plan view of one of the eight identically shaped toy elements of the second set of the present invention.
Figure 5B:
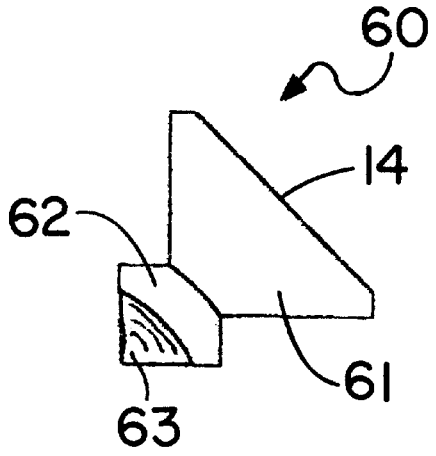
FIG. 5*b* shows another plan view of one of the eight identically shaped toy elements of the second set of the present invention.

The second set of eight toy identical elements 60 each includes a triangular surface 14 which forms part of the geometric solid surface. Referring to FIGS. 5*a* and 5*b*, two views of one of the toy elements 60 of the second set are shown. Each toy element 60 includes a tetrahedron body 61 (three-sided pyramid) with an integrally formed cam element 62 located at one corner of the tetrahedron body 61. Preferably, the cam element 62 is a cubical solid body. The flat triangular surface 14 opposite the attached cam element 62 is one of the surfaces of the exterior of the octagon cube toy 10. The cam element 62 includes a spherical section surface 63 with concavity in opposition to the opposed triangular surface 14 of the tetrahedron body 61 of the toy element 60.

Figure 6A:
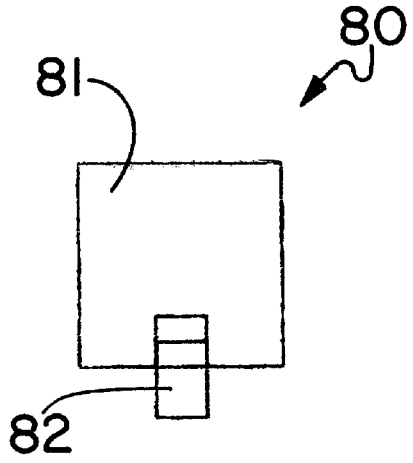
FIG. 6*a* shows a plan view of one of the twelve identically shaped toy elements of the third set of the present invention.
Figure 6B:
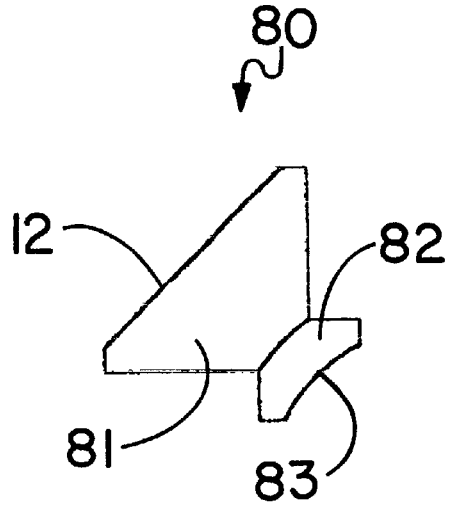
FIG. 6*b* shows another plan view of one of the twelve identically shaped toy elements of the third set of the present invention.

The third set of twelve identical toy elements 80 each includes a square surface 12 which forms part of the geometric solid surface. Referring to FIGS. 6*a* and 6*b*, two views of one of the toy elements 80 of the second set are shown. Each toy element 80 includes a five sided solid triangular body 81 with an integrally formed cam element 82 located at a midpoint of one edge of the solid triangular body 81. Preferably, the cam element 82 is a solid rectangular body. The flat square surface 12 opposite the attached cam element 82 is one of the surfaces of the exterior of the octagon cube toy 10. The cam element 82 includes a spherical section surface 83 with concavity in opposition to the opposed square surface 12 of the solid triangular body 81 of the toy element 80.

Referring again to FIG. 2, a cross-sectional view of the octagon cube toy 10 taken along a plane formed by any of the two coordinate axes is shown. The spherical core member 20 with connector assemblies 25 secure one of each of the six T-shaped toy elements 40 of the first set to one of the core assemblies 25 as described above.

The third set of twelve identical toy elements 80, each with the cam spherical section surface 83 adjacent the spherical core member 20, are held in position between pairs of T-shaped toy elements 40 of the first set. The second set of eight identical toy elements 60, each with the cam spherical section surface 63 adjacent the spherical core member 20, are held in position between three adjacent toy elements 80 of the third set, as illustrated in FIGS. 8 and 9*a*–9*c*. The biasing spacers 42 maintain the T-shaped toy elements 40 in interlocking relationship with the other toy elements 60, 80, yet allow slight movement of groups of nine adjacent toy elements away from the spherical core member 20 and rotation of the nine adjacent toy elements relative to the remainder of the octagon cube toy 10. The spherical section surfaces 63, 83 of the second and third sets of toy elements 60, 80 move smoothly over the surface of the spherical core member 20 during rotation of portions of the 10, thereby preventing binding due to misalignment of the various toy elements.

The configuration of the three sets of toy elements 40, 60, 80 described above allows for any group of nine adjacent toy elements with a T-shaped element 40 at the center, to be rotated about one of the connector assemblies 25, which constitutes one of the coordinate axes, relative to the remainder of the octagon cube toy 10.

Figure 10A:
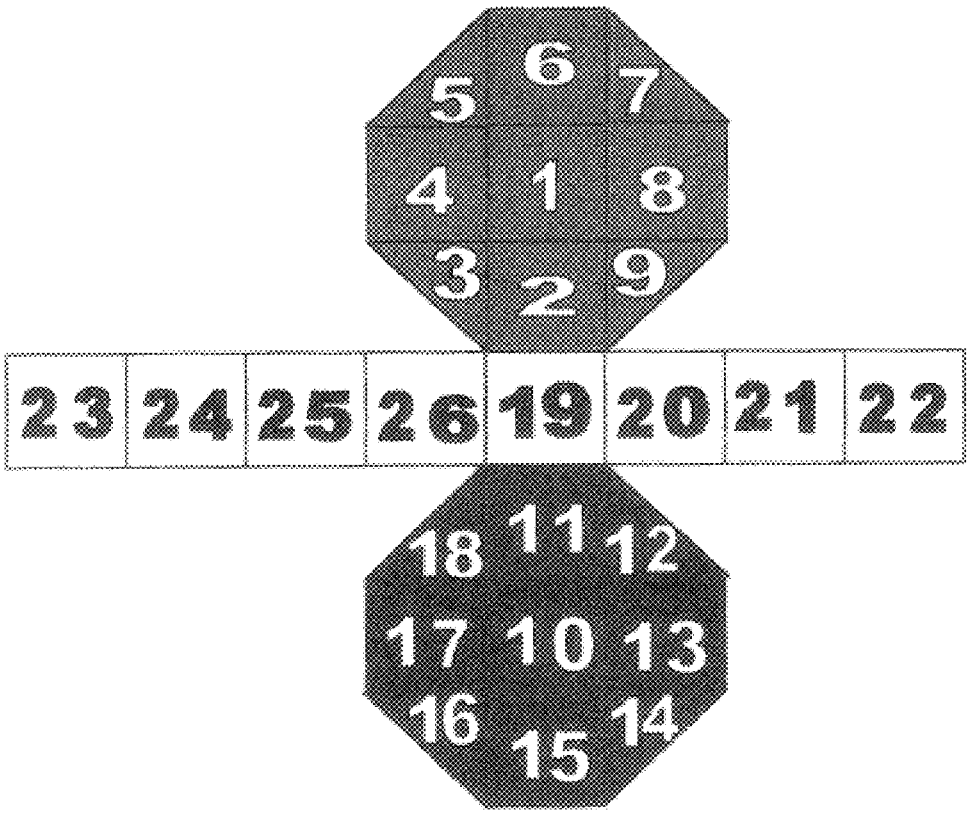
FIG. 10*a* shows the configuration of the numerical and color designations for the twenty-six flat surfaces of the toy of the present invention.

The highly symmetrical structure of the octagon cube toy 10 does not provide for a toy of much interest. To make for a more interesting and challenging spacial toy 10, each of the twenty-six planar exterior surfaces 12, 14 of the octagon cube spacial toy 10 is provided with a unique designation, such as a number (1–26) as illustrated in FIG. 10*a*, or a letter (A–Z) and, additionally, each planar surface having one of three different colors.

The planar exterior surfaces 12, 14 are designated (numbered or lettered) sequentially, beginning with a top section, then a bottom section, and finally the equator section of the octagon cube toy 10. The planar exterior surfaces 12, 14 of the top section, bottom section and equator section are each provided with a different color as well. The numbering/lettering and color designation for each of the twenty-six planar exterior surfaces 12, 14 of the octagon cube toy 10 are shown in FIG. 10*a*. The colors chosen are red, white and blue, although any combination of three colors is acceptable.

Figure 10B:
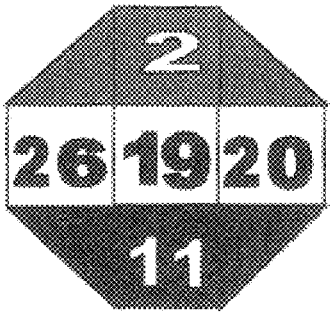
FIG. 10*b* shows one plan view of the numerical and color designations of the assembled surfaces of the toy of the present invention.
Figure 13:
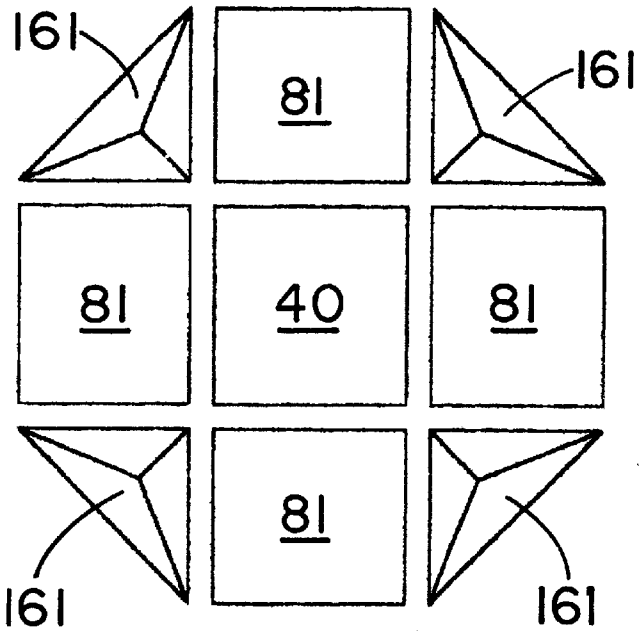
FIG. 13 shows the configuration of the second embodiment of the three sets of toy elements viewed from exterior the octagon cube toy along any of the symmetry axes.

The faces of the octagon cube toy 10 are mixed by multiple rotation of any of the various nine element portions as described above. The objective is to return the exterior surfaces 12, 14 of the octagon cube toy 10 to the beginning configuration with the numbers/letters in sequence and the three colors together as shown in FIG. 10*b*.

Figure 11:
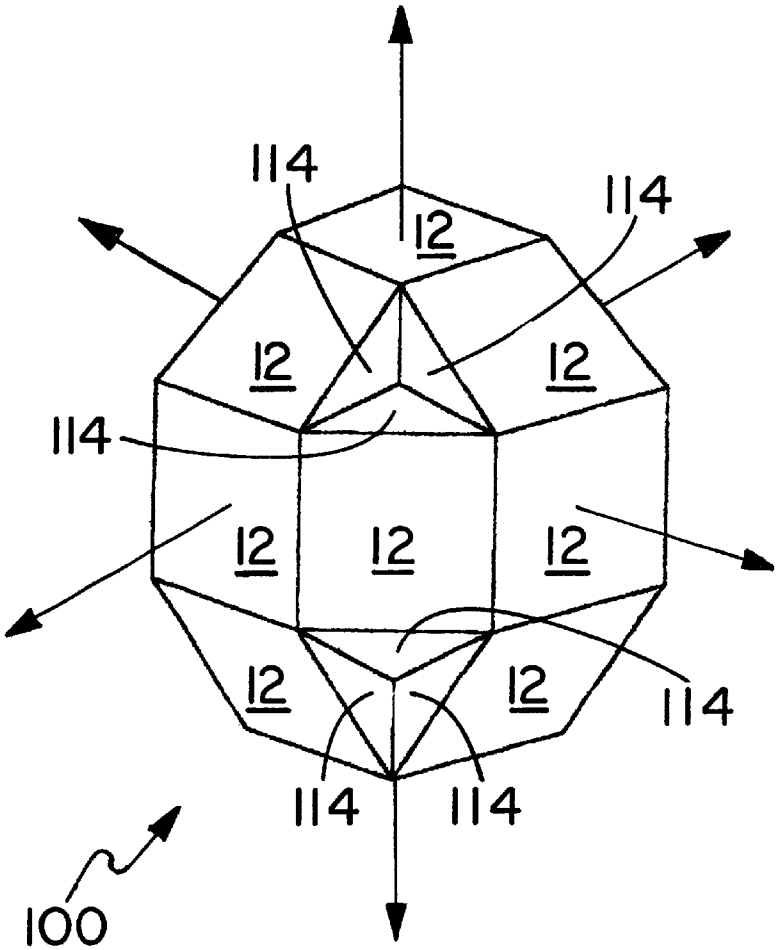
FIG. 11 shows another embodiment of the octagon-cube toy in the assembled state.

Referring now to FIG. 11, another embodiment of the octagon cube spacial logical toy 100 of the present invention is shown. Those elements of the octagon cube toy 100 in common with the octagon cube toy 10 described above are designated with the same number. The octagon cube spacial logical toy 100 is a regular geometric solid having a total of forty-two planar exterior surfaces. The surfaces include eighteen square surfaces 12 and twenty-four triangular surfaces 114 and is highly symmetrical with three orthogonal symmetry axes as depicted in FIG. 11. FIG. 2 also is a cross-sectional view of the toy 100 taken on one of the three planes formed by any two of the three orthogonal symmetry axes of FIG. 11. The cross-sectional view is a regular octagon and portions of the interior structure of the toy 100 are revealed in FIG. 2.

The spherical core member 20 of the toy 100 is shown in FIG. 3. The core member 20 includes six cylindrical connector assemblies 25 oriented along the three orthogonal symmetry axes of the toy 100. The connector assemblies 25 serve to anchor the twenty-six toy elements, each with at least one exterior surface, that make up the regular geometric surface of the toy 100. The toy 100 includes an assembly of twenty-six toy elements secured about the spherical core member 20 to generate a regular geometric solid with each toy element having at least one flat surface on the regular geometric solid surface.

The twenty-six toy elements that form the exterior surface of the toy 100 include three sets of toy elements, a first set of six identical elements 40, a second set of eight identical elements 160 and a third set of twelve identical elements 80. The second set of toy elements 160 and third set of toy elements 80 include integrally formed cam elements, each cam element having a spherical section surface for positioning adjacent the spherical core member 20.

The first set of six identical toy elements 40 are T-shaped with a hollow bore there through, as shown in FIGS. 4*a*–4*c*. The bore is sized to accept a cylindrical connector assembly 25 from the base 41 of the T-shaped element 40. The hollow bore is enlarged within the T-shaped element 40 to provide space for an elastomeric biasing cylindrical spacer member 42 to encircle the cylindrical connector assembly 25 and be retained thereon by a washer member 43 with a snap ring member 44 that clips into a groove 45 near the end of the cylindrical connector assembly 25, as depicted in FIGS. 7*a* and 7*b*. The T-shaped element 40 includes an open top for installing the biasing spacer 42 and washer member 43 plus snap ring retainer member 44 on the connector assembly 25 while it is within the T-shaped element 40. The T-shaped element 40 also includes a square cover member 46 with a lower lip portion 47 that fits into the open top bore of the element 40 to seal the connector assembly 25 therein. The lip portion 47 is preferably non-circular to prevent rotation of the square cover member 46 when engaged in the bore of the T-shaped element 40. The retained biasing spacer 42 maintains the T-shaped element 40 at a selected location on the connector assembly 25, but allows for slight movement of the T-shaped element 40 away from the spherical core member 20 along the connector assembly 25 by compression of the spacer 42 against the retaining washer 43.

Figure 12B:
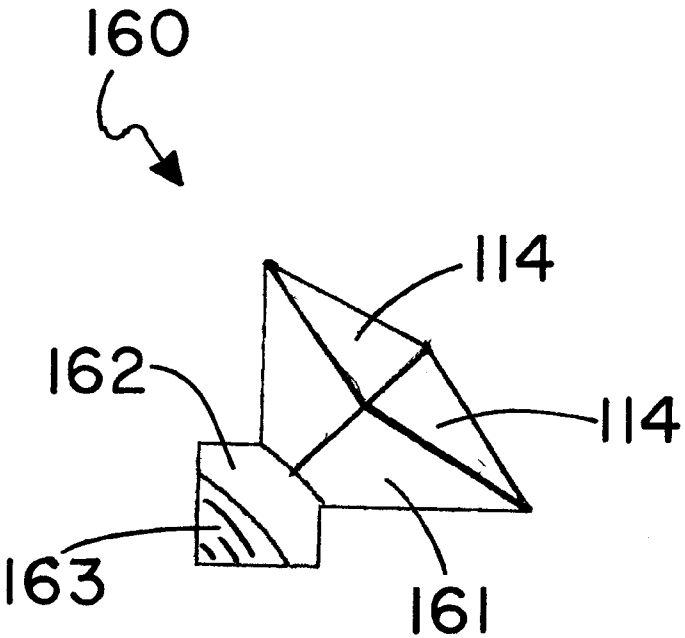
FIG. 12*b* shows another plan view of one of the eight identically shaped toy elements of the second set according to the second embodiment of the present invention.
Figure 12A:
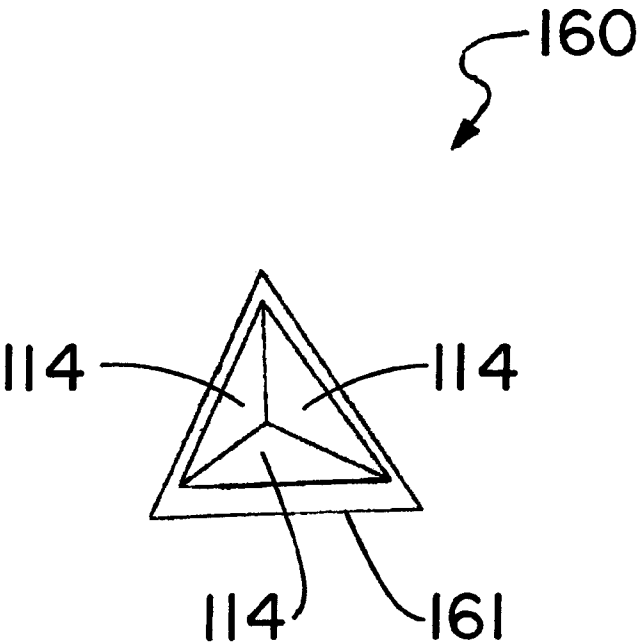
FIG. 12*a* shows a plan view of one of the eight identically shaped toy elements of the second set according to the second embodiment of the present invention.

The second set of eight toy identical elements 160 each includes three triangular surfaces 114 which form part of the geometric solid surface. Referring to FIGS. 12*a* and 12*b*, two views of one of the toy elements 160 of the second set are shown. Each toy element 160 includes a polyhedron body 161 comprised of two tetrahedrons (three-sided pyramids) joined at a base surface, with an integrally formed cam element 162 located at one end of the polyhedron body 161. Preferably, the cam element 162 is as cubical solid body. The three triangular surface 114 opposite the attached cam element 162 are a portion of the surfaces of the exterior of the octagon cube toy 100. The cam element 162 includes a spherical section surface 163 with concavity in opposition to the opposed three triangular surfaces 114 of the polyhedron body 161 of the toy element 160.

The third set of twelve identical toy elements 80 each includes a square surface 12 which forms part of the geometric solid surface. Referring again to FIGS. 6*a* and 6*b*, two views of one of the toy elements 80 of the second set are shown. Each toy element 80 includes a five sided solid triangular body 81 with an integrally formed cam element 82 located at a midpoint of one edge of the solid triangular body 81. Preferably, the came element 82 is a solid rectangular body. The flat square surface 12 opposite the attached cam element 82 is one of the surfaces of the exterior of the octagon cube toy 100. The cam element 82 includes a spherical section surface 83 with concavity in opposition to the opposed flat square surface 12 of the toy element 80.

Referring again to FIG. 2, a cross-sectional view of the octagon cube toy 100 taken along a plane formed by any of the two coordinate axes is shown. The spherical core member 20 with connector assemblies 25 secure one of each of the six T-shaped toy elements 40 of the first set to one of the core assemblies 25 as described above.

Figure 14C:
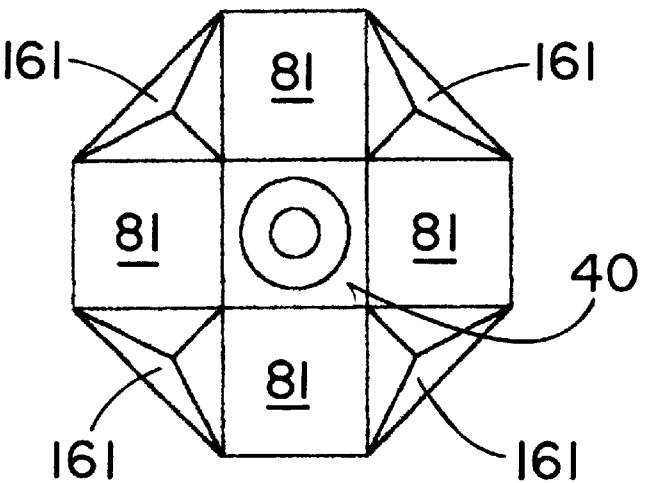
FIG. 14*c* shows the relationship according to the second embodiment between the first, second and third sets of toy elements of the present invention.
Figure 14B:
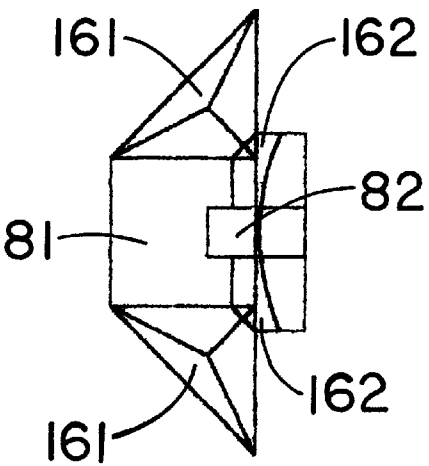
FIG. 14*b* shows the interlocking relationship according to the second embodiment between the second and third sets of toy elements of the present invention.
Figure 14A:
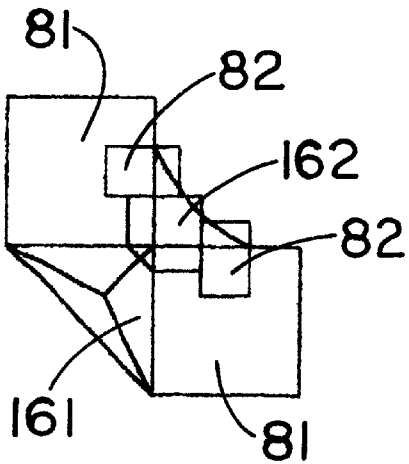
FIG. 14*a* shows the interlocking relationship according to the second embodiment between the second and third sets of toy elements of the present invention.

The third set of twelve identical toy elements 80, each with the cam spherical section surface 82 adjacent the spherical core member 20, are held in position between pairs of T-shaped toy elements 40 of the first set. The second set of eight identical toy elements 160, each with the cam spherical section surface 162 adjacent the spherical core member 20, are held in position between three adjacent toy elements 80 of the third set, as illustrated in FIGS. 14*a*–14*c*. The biasing spacers 42 maintain the T-shaped toy elements 40 in interlocking relationship with the other toy elements 160, 80, yet allow slight movement of groups of nine adjacent toy elements away from the spherical core member 20 and rotation of the nine adjacent toy elements relative to the remainder of the octagon cube toy 100.

The configuration of the three sets of toy elements 40, 160, 80 described above allows for any group of nine adjacent toy elements with a T-shaped element 40 at the center, to be rotated about one of the connector assemblies 25, which constitutes one of the coordinate axes, relative to the remainder of the octagon cube toy 100. The spherical section surfaces 163, 83 of the second and third sets of toy elements 160, 80 move smoothly over the surface of the spherical core member 20 during rotation of portions of the octagon cube toy 10, thereby preventing binding due to misalignment of the various toy elements.

Figure 15:
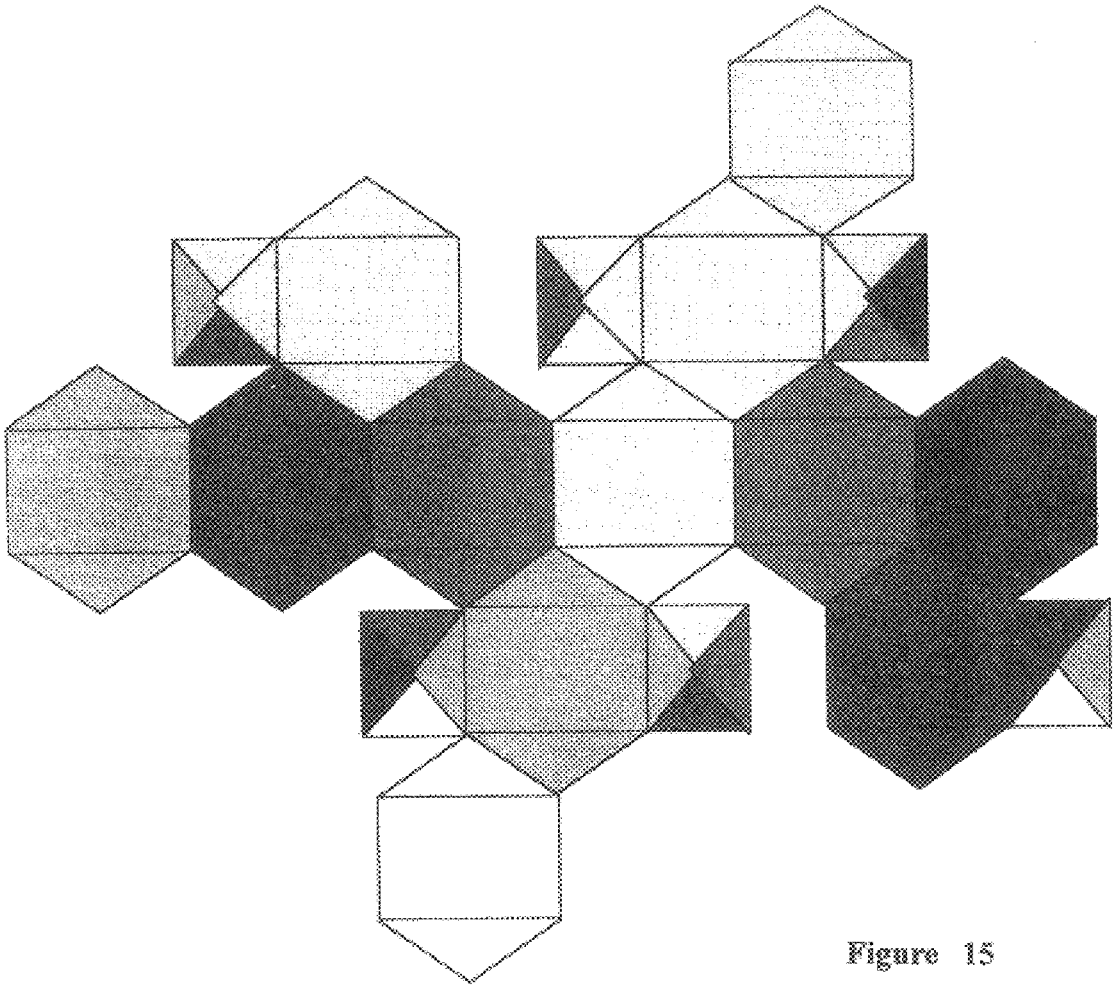
FIG. 15 shows the configuration according to the second embodiment of one example of the color designations for all forty-two flat surfaces of the toy of the present invention.

The highly symmetrical structure of the octagon cube toy 100 does not provide for a toy of much interest. To make for a more interesting and challenging spacial toy 100, each of the forty-two planar exterior surfaces of the octagon cube spacial toy 100 is provided with a unique designation, such as a number (1–42) or, more preferably, with one of twelve different colors, as seen in FIG. 15. Referring now to FIG. 15, each of the third set of twelve toy elements 80 includes a square surface 12, each of a single different color. Each square surface 12 of the toy elements 80 has two pair of opposing edges. Each opposing edge of one pair abuts one edge of another square surface 12 of a toy element 40 of the first set. Each opposing edge of the other pair abuts one edge of a triangular surface 114 of a toy element 160 of the second set. Each of the three triangular surfaces 114 of each toy element 160 of the second set abuts a different square surface 12 of the toy elements 80, with each abutting triangular surface 114 colored the same as the adjacent square surface 12 of the toy elements 80. Each of the four edges of the square surfaces 12 of the toy elements 40 of the first set abuts a different colored square surface 12 of toy elements 80 of the third set. The square surface 12 of toy elements 40 of the first set is quartered diagonally to give four triangular areas 12*a*, 12*b*, 12*c* and 12*d*. Each triangular area 12*a*, 12*b*, 12*c* and 12*d* is colored to match the abutting square surface 12 of the toy elements 80 of the third set. Each of the twelve single color square surfaces 12 of toy elements 80 combined with two abutting triangular surfaces 114 of like color of the toy elements 160 produce a flat hexagon surface of a single color. This configuration for the toy 100 is designated as the puzzle solution.

Figure 16:
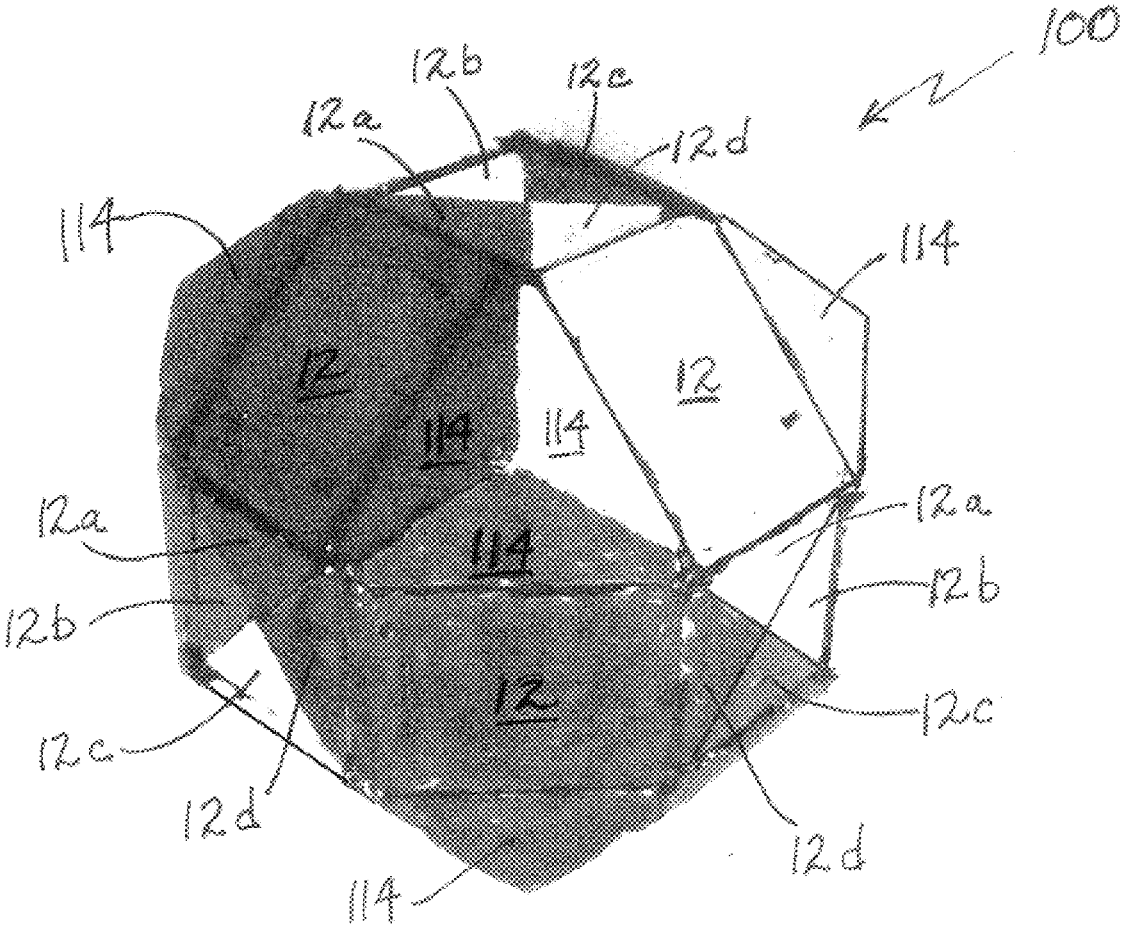
FIG. 16 shows a perspective view of the color designations for some of the surfaces of the toy in an assembled state according to the second embodiment of the present invention.

The faces of the octagon cube toy 100 are mixed by multiple rotation of any of the various 20 nine element portions as described above. The objective is to return the exterior surfaces of the octagon cube toy 100 to the beginning configuration with the designations in sequence and the twelve colors together as shown in FIG. 16.

While the invention has been particularly shown and described with reference to preferred embodiments thereof, it will be understood by those skilled in the art that various changes in form and details may be made therein without departing from the spirit and scope of the invention.

I claim:

1. An octagon cube spacial logical toy having a total of twenty-six planar exterior surfaces comprising;

(a) a spherical core member including six cylindrical connector assemblies oriented along three orthogonal symmetry axes;

(b) a first set of six identical elements, each element comprising a T-shaped member including a square top portion and perpendicular base portion, the T-shaped member with a hollow bore there through adapted to accept a cylindrical connector assembly from a base portion end thereof, the connector assembly having a retainer means for securing the T-shaped member thereon, and a square cap portion secured over the hollow bore of the T-shaped member opposite the connector assembly;

(c) a second set of eight identical elements, each element comprising a tetrahedron member with an integrally formed cam element located at one corner of the tetrahedron member opposite a triangular surface thereof, the cam element including a spherical section surface with concavity in opposition to the opposed triangular surface of the tetrahedron member opposite the cam element; and (d) a third set of twelve identical elements, each element comprising a solid triangular member with an integrally formed cam element located at a midpoint of one edge of the solid triangular member opposite a square surface thereof, the cam element including a spherical section surface with concavity in opposition to the opposed square surface of the solid triangular member opposite the cam element;

(e) whereby each T-shaped member of the first set of elements is secured to a cylindrical connector assembly of the spherical core member with the square cap portion on the toy exterior, each solid triangular member of the third set of elements is positioned between two adjacent T-shaped members of the first set of elements with the cam spherical section surface adjacent the spherical core member and opposed square surface on the toy exterior, and each tetrahedron member of the second set of elements is positioned between three adjacent solid triangular members of the third set of elements with the cam spherical section surface adjacent the spherical core member and opposed triangular surface on the toy exterior, thereby forming a spacial toy with twenty-six exterior surfaces.

2. The octagon cube spacial logical toy according to claim 1 wherein said cylindrical connector assembly includes a cylindrical shaft member with a cylindrical biasing spacer member retained thereon by a washer member surrounding the cylindrical shaft member, the washer member secured by a snap ring member fitted in a groove in the cylindrical shaft member at an end opposite the spherical core member.

3. The octagon cube spacial logical toy according to claim 1 wherein said second set of toy elements includes a solid cubical cam member located at one corner of the tetrahedron member opposite a triangular surface thereof, the solid cubical cam element including a spherical section surface with concavity in opposition to the opposed triangular surface of the tetrahedron member opposite the cam element.

4. The octagon cube spacial logical toy according to claim 1 wherein said third set of toy elements includes a solid rectangular cam member located at a midpoint of one edge of the solid triangular member opposite a square surface thereof, the solid rectangular cam element including a spherical section surface with concavity in opposition to the opposed square surface of the solid triangular member opposite the cam element.

5. The octagon cube spacial logical toy according to claim 1 wherein said twenty-six planar exterior surfaces are marked sequentially with twenty-six different identifiers.

6. The octagon cube spacial logical toy according to claim 5 wherein said twenty-six different identifiers include numbers 1 through 26.

7. The octagon cube spacial logical toy according to claim 5 wherein said twenty-six different identifiers include letters A through Z.

8. The octagon cube spacial logical toy according to claim 1 wherein a first group of nine adjacent exterior surfaces having a first T-shaped member of the first set of toy elements at a center thereof are of a first color, a second group of nine adjacent exterior surfaces having a second T-shaped member of the first set of toy elements at a center thereof are of a second color, the first and second T-shaped members positioned on a common symmetry axis, and a third group of eight adjacent exterior surfaces positioned between the first and second groups, the third group having alternating T-shaped members and solid triangular members, are of a third color.

9. An octagon cube spacial logical toy having a total of twenty-six planar exterior surfaces comprising;

(a) a spherical core member including six cylindrical connector assemblies oriented along three orthogonal symmetry axes, said cylindrical connector assembly including a cylindrical shaft member with a cylindrical biasing spacer member retained thereon by a washer member surrounding the cylindrical shaft member, the washer member secured by a snap ring member fitted in a groove in the cylindrical shaft member at an end opposite the spherical core member;

(b) a first set of six identical elements, each element comprising a T-shaped member including a square top portion and perpendicular base portion, the T-shaped member with a hollow bore there through adapted to accept a cylindrical connector assembly from a base portion end thereof, the connector assembly having a retainer means for securing the T-shaped member thereon, and a square cap portion secured over the hollow bore of the T-shaped member opposite the connector assembly;

(c) a second set of eight identical elements, each element comprising a tetrahedron member with an integrally formed solid cubical cam element located at one corner of the tetrahedron member opposite a triangular surface thereof, the solid cubical cam element including a spherical section surface with concavity in opposition to the opposed triangular surface of the tetrahedron member opposite the cam element; and (d) a third set of twelve identical elements, each element comprising a solid triangular member with an integrally formed solid rectangular cam element located at a midpoint of one edge of the solid triangular member opposite a square surface thereof, the solid rectangular cam element including a spherical section surface with concavity in opposition to the opposed square surface of the solid triangular member opposite the cam element;

(e) whereby each T-shaped member of the first of elements is secured to a cylindrical connector assembly of the spherical core member with the square cap portion on the toy exterior, each solid triangular member of the third set of elements is positioned between two adjacent T-shaped members of the first set of elements with the cam spherical section surface adjacent the spherical core member and opposed square surface on the toy exterior, and each tetrahedron member of the second set of elements is positioned between three adjacent solid triangular members of the third set of elements with the cam spherical section surface adjacent the spherical core member and opposed triangular surface on the toy exterior, thereby forming a spacial toy with twenty-six exterior surfaces, each exterior surface of the toy marked sequentially with one of twenty-six different identifiers.

10. The octagon cube spacial logical toy according to claim 9 wherein said twenty-six different identifiers include numbers 1 through 26.

11. The octagon cube spacial logical toy according to claim 9 wherein said twenty-six different identifiers include letters A through Z.

12. An octagon cube spacial logical toy having a total of forty-two planar exterior surfaces comprising;

(a) a spherical core member including six cylindrical connector assemblies oriented along three orthogonal symmetry axes;

(b) a first set of six identical elements, each element comprising a T-shaped member including a square top portion and perpendicular base portion, the T-shaped member with a hollow bore there through adapted to accept a cylindrical connector assembly from a base portion end thereof, the connector assembly having a retainer means for securing the T-shaped member thereon, and a square cap portion secured over the hollow bore of the T-shaped member opposite the connector assembly;

(c) a second set of eight identical elements, each element comprising a double tetrahedron member with an integrally formed cam element located at one end of the double tetrahedron member opposite three triangular surfaces thereof, the cam element including a spherical section surface with concavity in opposition to the opposed three triangular surfaces of the double tetrahedron member opposite the cam element; and (d) a third set of twelve identical elements, each element comprising a solid triangular member with an integrally formed cam element located at a midpoint of one edge of the solid triangular member opposite a square surface thereof, the cam element including a spherical section surface with concavity in opposition to the opposed square surface of the solid triangular member opposite the cam element;

(e) whereby each T-shaped member of the first set of elements is secured to a cylindrical connector assembly of the spherical core member with the square cap portion on the toy exterior, each solid triangular member of the third set of elements is positioned between two adjacent T-shaped members of the first set of elements with the cam spherical section surface adjacent the spherical core member and opposed square surface on the toy exterior, and each double tetrahedron member of the second set of elements is positioned between three adjacent solid triangular members of the third set of elements with the cam spherical section surface adjacent the spherical core member and opposed three triangular surfaces on the toy exterior, thereby forming a spacial toy with forty-two exterior surfaces.

13. The octagon cube spacial logical toy according to claim 12 wherein said cylindrical connector assembly includes a cylindrical shaft member with a cylindrical biasing spacer member retained thereon by a washer member surrounding the cylindrical shaft member, the washer member secured by a snap ring member fined in a groove in the cylindrical shaft member at an end opposite the spherical core member.

14. The octagon cube spacial logical toy according to claim 12 wherein said second set of toy elements includes a solid cubical cam member located at one end of the double tetrahedron member opposite the three triangular surfaces thereof, the solid cubical cam element including a spherical section surface with concavity in opposition to the opposed three triangular surfaces of the double tetrahedron member opposite the cam element.

15. The octagon cube spacial logical toy according to claim 12 wherein said third set of toy elements includes a solid rectangular cam member located at a midpoint of one edge of the solid triangular member opposite a square surface thereof, the solid rectangular cam element including a spherical section surface with concavity in opposition to the opposed square surface of the solid triangular member opposite the cam element.

16. The octagon cube spacial logical toy according to claim 12 wherein said forty-two planar exterior surfaces are marked sequentially with forty-two different identifiers.

17. The octagon cube spacial logical toy according to claim 16 wherein said forty-two different identifiers include numbers 1 through 42.

18. The octagon cube spacial logical toy according to claim 12 wherein each of said twelve exterior square surfaces of the third set of twelve toy elements each are of a different color, each of said six exterior square cap portions of the first set of six toy elements is diagonally quartered with each quarter the same color as an adjacent square surface of the third set of toy elements, and each of said three exterior triangular surfaces of the second set of eight toy elements is the same color as an adjacent square surface of the third set of toy elements, whereby each of said twelve exterior square surfaces of the third set of twelve toy elements and two adjacent triangular surfaces of the second set of eight toy elements form a hexagon of one of the twelve different colors.

19. An octagon cube spacial logical toy having a total of forty-two planar exterior surfaces comprising;

(a) a spherical core member including six cylindrical connector assemblies oriented along three orthogonal symmetry axes, said cylindrical connector assembly including a cylindrical shaft member with a cylindrical biasing spacer member retained thereon by a washer member surrounding the cylindrical shaft member, the washer member secured by a snap ring member fitted in a groove in the cylindrical shaft member at an end opposite the spherical core member;

(b) a first set of six identical elements, each element comprising a T-shaped member including a square top portion and perpendicular base portion, the T-shaped member with a hollow bore there through adapted to accept a cylindrical connector assembly from a base portion end thereof, the connector assembly having a retainer means for securing the T-shaped member thereon, and a square cap portion secured over the hollow bore of the T-shaped member opposite the connector assembly;

(c) a second set of eight identical elements, each element comprising a double tetrahedron member with an integrally formed solid cubical cam element located at one end of the double tetrahedron member opposite three triangular surfaces thereof, the cam element including a spherical section surface with concavity in opposition to the opposed three triangular surfaces of the double tetrahedron member opposite the cam element; and (d) a third set of twelve identical elements, each element comprising a solid triangular member with an integrally formed solid rectangular cam element located at a midpoint of one edge of the solid triangular member opposite a square surface thereof, the cam element including a spherical section surface with concavity in opposition to the opposed square surface of the solid triangular member opposite the cam element;

(e) whereby each T-shaped member of the first set of elements is secured to a cylindrical connector assembly of the spherical core member with the square cap portion on the toy exterior, each solid triangular member of the third set of elements is positioned between two adjacent T-shaped members of the first set of elements with the cam spherical section surface adjacent the spherical core member and opposed square surface on the toy exterior, and each double tetrahedron member of the second set of elements is positioned between three adjacent solid triangular members of the third set of elements with the cam spherical section surface adjacent the spherical core member and opposed three triangular surfaces on the toy exterior, thereby forming a spacial toy with forty-two exterior surfaces.

20. The octagon cube spacial logical toy according to claim 19 wherein each of said twelve exterior square surfaces of the third set of twelve toy elements each are of a different color, each of said six exterior square cap portions of the first set of six toy elements is diagonally quartered with each quarter the same color as an adjacent square surface of the third set of toy elements, and each of said three exterior triangular surfaces of the second set of eight toy elements is the same color as an adjacent square surface of the third set of toy elements, whereby each of said twelve exterior square surfaces of the third set of twelve toy elements and two adjacent triangular surfaces of the second set of eight toy elements form a hexagon of one of the twelve different colors.

* * * * *